US010801251B2

(12) United States Patent
Ege et al.

(10) Patent No.: US 10,801,251 B2
(45) Date of Patent: Oct. 13, 2020

(54) DEVICES AND METHODS FOR MOUNTING DOOR FRAMES

(71) Applicant: Masonite Corporation, Tampa, FL (US)

(72) Inventors: Patrick C. Ege, Westmont, IL (US); Roldan Vazquez, St. Charles, IL (US); William W. Kling, Lombard, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 16/531,548

(22) Filed: Aug. 5, 2019

(65) Prior Publication Data

US 2019/0352959 A1 Nov. 21, 2019

Related U.S. Application Data

(62) Division of application No. 15/455,741, filed on Mar. 10, 2017, now Pat. No. 10,370,892.

(60) Provisional application No. 62/307,148, filed on Mar. 11, 2016, provisional application No. 62/417,029, filed on Nov. 3, 2016.

(51) Int. Cl.

| | |
|---|---|
| ***E06B 3/00*** | (2006.01) |
| ***E06B 3/26*** | (2006.01) |
| ***E06B 1/04*** | (2006.01) |
| ***E06B 1/30*** | (2006.01) |
| ***E04F 21/00*** | (2006.01) |
| ***E05D 1/02*** | (2006.01) |
| ***E06B 1/52*** | (2006.01) |
| ***E06B 1/56*** | (2006.01) |
| ***E06B 3/96*** | (2006.01) |

(52) U.S. Cl.

CPC ..... *E06B 3/26* (2013.01); *E04F 21/0015* (2013.01); *E05D 1/02* (2013.01); *E06B 1/045* (2013.01); *E06B 1/30* (2013.01); *E06B 1/52* (2013.01); *E06B 1/56* (2013.01); *E06B 3/96* (2013.01); *E05Y 2900/132* (2013.01)

(58) Field of Classification Search

CPC ..... E06B 3/26; E06B 3/96; E06B 1/30; E06B 1/045; E06B 1/52; E06B 1/56; E04F 21/0015; E05D 1/02; E05Y 2900/132

USPC ..... 49/506, 380; 52/217; 206/325

See application file for complete search history.

(56) References Cited

U.S. PATENT DOCUMENTS

| | | | |
|---|---|---|---|
| 3,707,057 | A | 12/1972 | Frydenberg |
| 3,729,870 | A | 5/1973 | Kvalheim et al. |
| 4,019,303 | A | 4/1977 | McAllister |
| 4,821,472 | A | 4/1989 | Tix |
| 4,958,469 | A | 9/1990 | Plummer |
| 4,999,957 | A | 3/1991 | Kessler |
| 5,119,609 | A | 6/1992 | Tait et al. |
| 5,572,840 | A | 11/1996 | Fast et al. |

(Continued)

*Primary Examiner* — Jerry E Redman

(74) *Attorney, Agent, or Firm* — Berenato & White, LLC

(57) ABSTRACT

The present invention relates to a door frame, particularly a door frame for a pre-hung door assembly, which is foldable to minimize storage space and to allow for enhanced logistic efficiencies. The door frame contains parallel, spaced apart, vertical jambs and a horizontal header connecting the top ends of the jambs. Each of the jambs and the horizontal header contains a front section and back section that are hingedly joined so that then can be folded on to each other. The hingedly joined front and back sections allow the door fame to be foldable to minimize space occupied during storage.

20 Claims, 6 Drawing Sheets

(56) References Cited

U.S. PATENT DOCUMENTS

| | | | | |
|---|---|---|---|---|
| 5,619,828 | A | 4/1997 | Ver Meer | |
| 5,644,881 | A | 7/1997 | Neilly | |
| 5,722,207 | A | 3/1998 | Anderson et al. | |
| 6,223,484 | B1 | 5/2001 | Minter | |
| 10,370,892 | B2 * | 8/2019 | Ege | E04F 21/0015 |
| 2005/0183374 | A1 * | 8/2005 | Valdez | E04F 21/0015 52/633 |
| 2008/0127564 | A1 | 6/2008 | Burton | |
| 2008/0222979 | A1 | 9/2008 | Rissmiller | |
| 2012/0240494 | A1 | 9/2012 | Schroeder et al. | |
| 2014/0261991 | A1 | 9/2014 | Cucchi et al. | |
| 2015/0075109 | A1 | 3/2015 | Bergevin | |
| 2017/0260796 | A1 | 9/2017 | Ege | |

* cited by examiner

DEVICES AND METHODS FOR MOUNTING DOOR FRAMES

CROSS-REFERENCE TO RELATED APPLICATIONS AND CLAIM TO PRIORITY

This application is a divisional of U.S. patent application Ser. No. 15/455,741, filed Mar. 10, 2017, now U.S. Pat. No. 10,370,892, which claims priority to U.S. Provisional Patent Application No. 62/307,148, filed Mar. 11, 2016, and 62/417,029, filed Nov. 3, 2016, the disclosures of which are incorporated herein by reference.

FIELD OF THE INVENTION

The present invention relates to a door frame, particularly a door frame for a pre-hung door assembly, which is foldable to minimize storage space during shipping and to allow for enhanced logistic efficiencies.

BACKGROUND

Many doors, either commercial or residential, are purchased as pre-hung door assemblies. A pre-hung door assembly is delivered for installation with the door already hingedly connected to the door frame that is to be inserted into the building opening where the door is to be located. Pre-hanging is accomplished by attaching the door to one side of the door frame, typically by one or more hinges. The other side of the door may be provided with a lockset and knob opening. The jamb member positioned immediately adjacent to the lockset and knob opening side is fitted with a latch or striker plate and associated opening so that the door can be securely shut after it has been installed. Pre-hanging is usually performed at the door-making facility, which typically is remote from where the door and its frame are to be installed. Once the door has been pre-hung it needs to be shipped, typically by truck, to the building location.

Doors, especially pre-hung door assemblies, are usually stored by placing one directly adjacent to another front-to-back. This method of storage maximizes space usage by eliminating spaces between adjacent door assemblies. It is, therefore, desirable to have a door frame with a small foot print so that wasted space is further eliminated for efficient storage and enhanced logistic efficiencies. In other words, more doors and their frames can be shipped by truck if the foot print is reduced. Shipping can be expensive and thus costly, so minimizing that expense is important to reducing costs.

SUMMARY OF THE INVENTION

An object of the present invention is to provide a door frame, particularly a door frame of a pre-hung door assembly. The door fame is configured to be foldable to minimize space occupied during storage and shipment. The door frame contains parallel, spaced apart, vertical jambs and a horizontal header connecting the top ends of the jambs. Each of the jambs and the horizontal header contains a front section and back section that are hingedly joined so that the front section can be folded onto the back section or vice versa. In the folded position, the door frame has a reduced foot print and takes up less space than in the unfolded or installation orientation.

Another object of the present invention is to provide a pre-hung door assembly. The assembly includes a foldable door frame with a door slab hingedly hung on one of the door jambs. The door jambs and/or horizontal header may contain a door stop on their inner surface to function as a stop preventing the door slab from swinging through the opening of the frame.

Further objects of the present invention include methods for making the door frame and pre-hung door assembly, and methods for installing the pre-hung door assembly.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION

Figure 1:
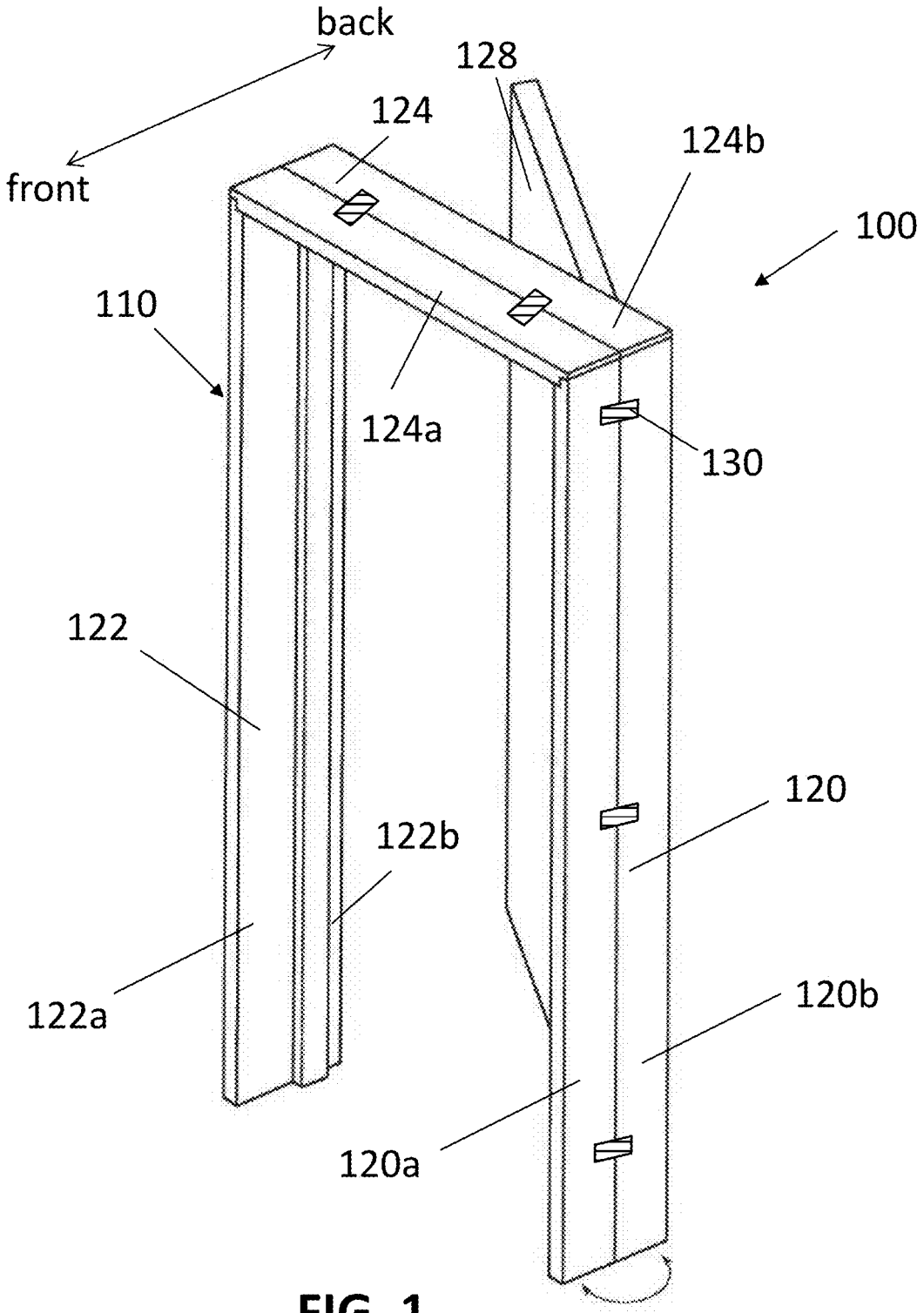
FIG. 1 is a perspective view of a door frame in an opened or installation orientation.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods. Like reference characters refer to like parts throughout the drawings.

Referring to FIG. 1, the present invention provides a pre-hung door assembly 100 and methods for mounting the pre-hung door assembly 100 in a wall opening of a building. The door opening is typically framed by building studs connected by an opening header at the top of the studs. The door opening is prepared for a selected door frame size, so that a door frame 110 of selected size can fit and be retained therein.

The pre-hung door assembly 100 typically contains the door frame 110 and a door slab 128 hung therein. The door frame 110 is typically formed by parallel, spaced apart, vertical jambs 120 (hinge side jamb), 122 (lock side jamb) and a horizontal header 124 connecting the top ends of the jambs 120, 122, typically with mechanical fasteners. The jambs 120, 122 and horizontal header 124 are typically made of wood, such as pine, fir, with pine being preferred, although hardwoods may also be used; plastics; or composite materials. Preferably, the door jambs 120, 122 are constructed as flat jambs rather than split jambs. Optionally, the door frame 110 may also include a sill installed at the foot of the frame 110 and connecting the lower ends of the jambs 120, 122.

A door slab 128 is provided with the door frame 110, as shown in FIG. 1, to form the pre-hung door assembly 100. The doors slab 128 may be solid core or hollow core and constructed, e.g., as described in U.S. Patent Application Publication No. 2014/0261991, the disclosure of which is incorporated herein by reference. The door slab 128 may be hingedly attached to the hinge side jamb 120 by two or more door hinges. Two, three, four, five, or more door hinges may be used to attach the door slab 128 to the hinge side jamb 120, depending on the size of the door. For a typical door used in a home, three hinges are typically used to mount the door slab 128 to the door frame 110. The door hinges may be typical hinges, such as made from steel, used to mount doors to allow the door slab 128 to swing between a closed position and an opened position within the door frame 110. As used herein and shown in FIG. 1 via the arrow, the side toward which the door slab 128 opens is referred to as the back side, while the opposing side is referred to as the front side. Preferably, the door jambs 120, 122 and/or horizontal header 124, each contains a door stop (best shown as 300 in FIG. 3) on its inner surface. The door stop 300 functions as a stop for the door slab 128, not allowing it to swing through the opening without damage to the hinges.

Figure 6:
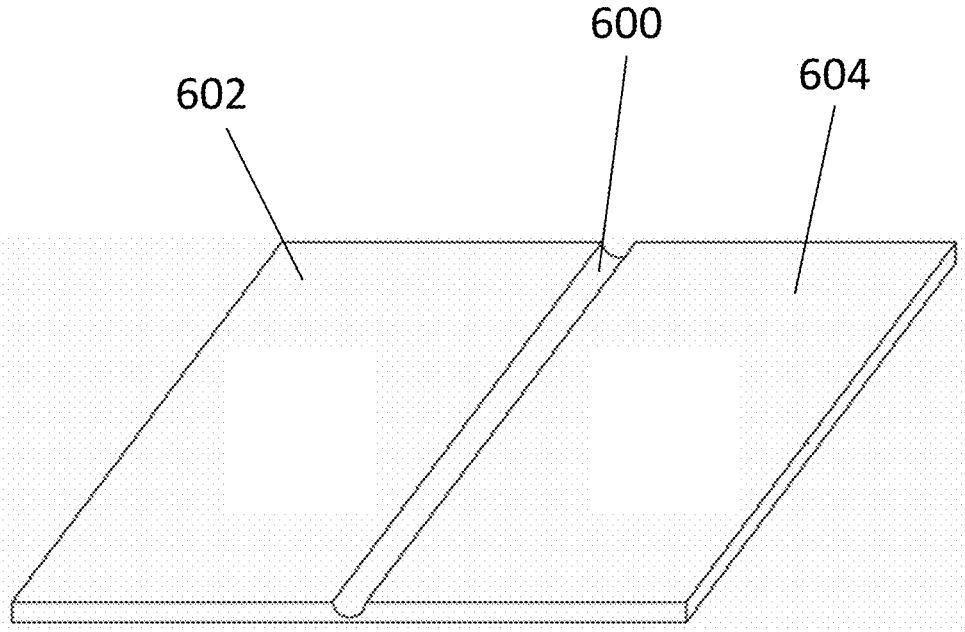
FIG. 6 is a perspective view of a living hinge.

FIG. 1 shows the frame 110 in an unfolded or installation orientation, where each member of the frame (the jambs 120, 122 and the horizontal header 124) contains a front section and back section. The hinge side jamb 120 contains a front section 120*a* and a back section 120*b*; the lock side jamb 122 contains a front section 122*a* and a back section 122*b*; and the horizontal header 124 contains a front section 124*a* and a back section 124*b*. Each of the front sections 120*a*, 122*a*, and 124*a* are joined by one or more hinges 130 to its respective back section 120*b*, 122*b*, 124*b*. The hinge 130 may be a living hinge (a thin flexible section connecting the front section 120*a*, 122*a*, or 124*a* to its corresponding back section 120*b*, 122*b*, or 124*b*) when the frame 110 is made of resilient plastic, such as polypropylene ethylene (PPE), high density polyethylene (HDPE), polyethylene, nylon, polyvinyl chloride (PVC), or combinations thereof, or a resilient composite material, such as wood composite (e.g. particle board or fiberboard), polymer based composites (e.g. fiberglass/polyester resin or wood fiber/polyethylene), or combinations thereof, or may be a flexible material, such as a strap or a tape (as best shown in FIG. 1). The living hinge may be formed separately from the resilient plastic material and attached to the front and back sections, e.g. by adhesive. Such a separate living hinge, as illustrated in FIG. 6, contains a thin section 600 between two thicker sections 602, 604. The thick sections 602, 604 are attached to the front section 120*a*, 122*a*, or 124*a* and its corresponding back section 120*b*, 122*b*, or 124*b*. The thin section 600 allows the front section 120*a*, 122*a*, or 124*a* and back sections 120*b*, 122*b*, or 124*b* to be folded on each other. Alternatively, the hinges 130 may be conventional mechanical hinges, such as bi-fold metal hinges. When in an opened position ready for installation, as shown in FIG. 1, the front and back sections of each member of the frame 110 lay edge-to-edge with the back edge of the front section abutting the front edge of the back section, such that the hinges 130 lay flat on the outside of the frame 110. When a door slab 128 is present, it is preferably hingedly attached to the back section 120*b* of the hinge side door jamb 120. The hinge 130 may extend the complete span of the jamb 120, 122 and horizontal header 124, or may be applied in selected portions of the jamb 120, 122 and horizontal header 124.

Figure 2:
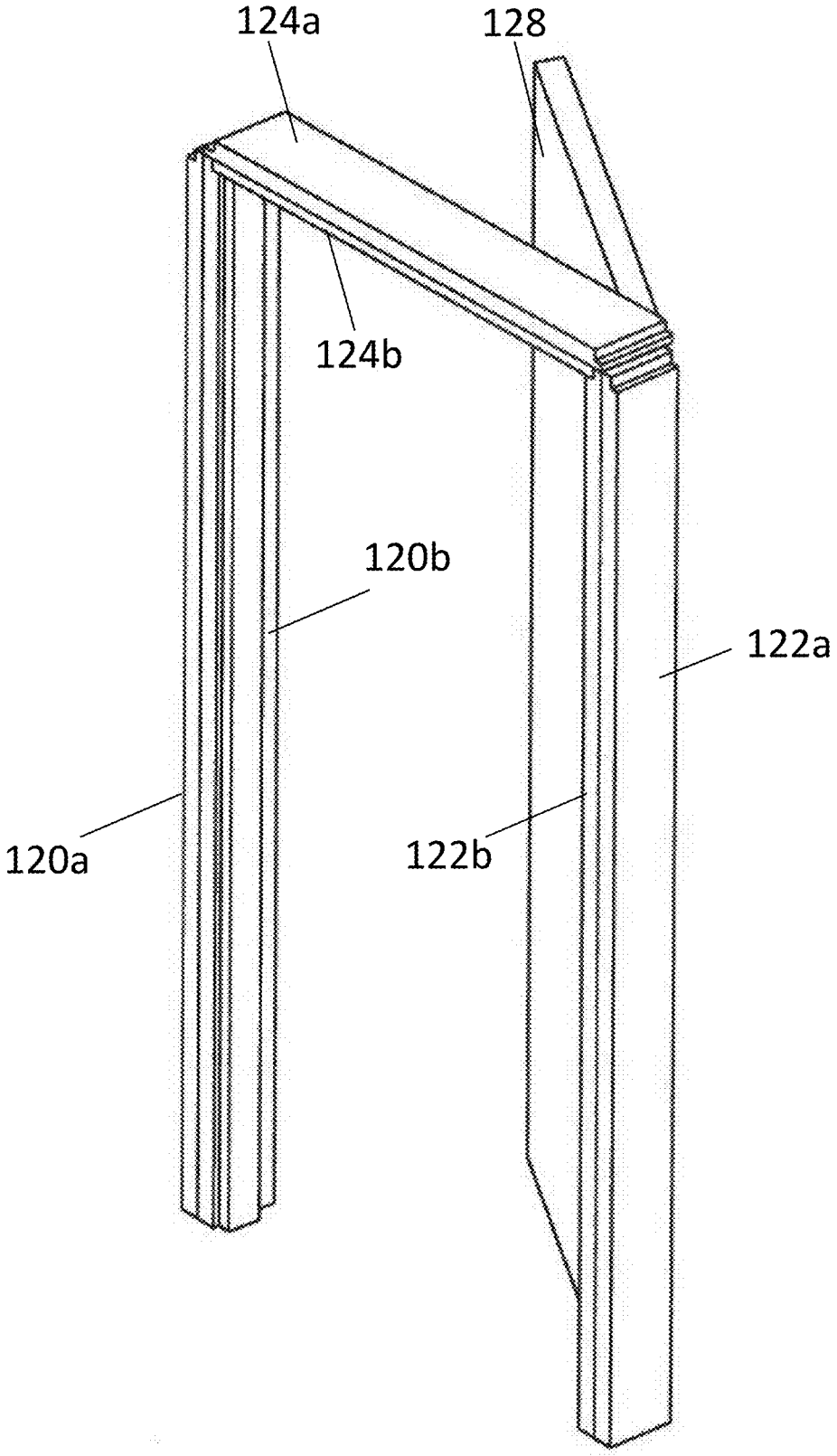
FIG. 2 is a perspective view of a door frame in a folded orientation.

For storage and shipping, the door frame 110 may be folded by laying the front sections 120*a*, 122*a*, 124*a* and back sections 120*b*, 122*b*, 124*b* of the door frame 110 one on top of the other, as best shown in FIG. 2. In an embodiment, the front sections 120*a*, 122*a*, 124*a* are folded back on the hinges 130, so that they lay on their corresponding back sections 120*b*, 122*b*, 124*b*. The front section 124*a* of the horizontal header 124 lays on the outside face of the back section 124*b*; the front section 120*a* of the lock side jamb 120 lays on the outside face of the back section 120*b*; and the front section 122*a* of the hinge side jamb 122 lays on the outside face of the back section 122*b*. When folded as illustrated in FIG. 2 (folded position), the door frame 110 has a reduced foot print and takes up less room front-to-back for convenient storage.

When ready for installation, the frame 110 is placed in the opened orientation, as best shown in FIG. 1, by folding the front sections 120*a*, 122*a*, 124*a* forwardly (toward the front of the door frame 110) and away from their corresponding back sections 120*b*, 122*b*, 124*b*. The front sections 120*a*, 122*a* of the door jambs 120, 122 may then be secured to either ends of the front section 124*a* of the horizontal header 124 by mechanical fasteners, such as screws, nails, brackets, or combinations thereof. Alternatively, the front sections 120*a*, 122*a*, 124*a* may be secured directly to the wall opening without being secured to each other.

Figure 3:
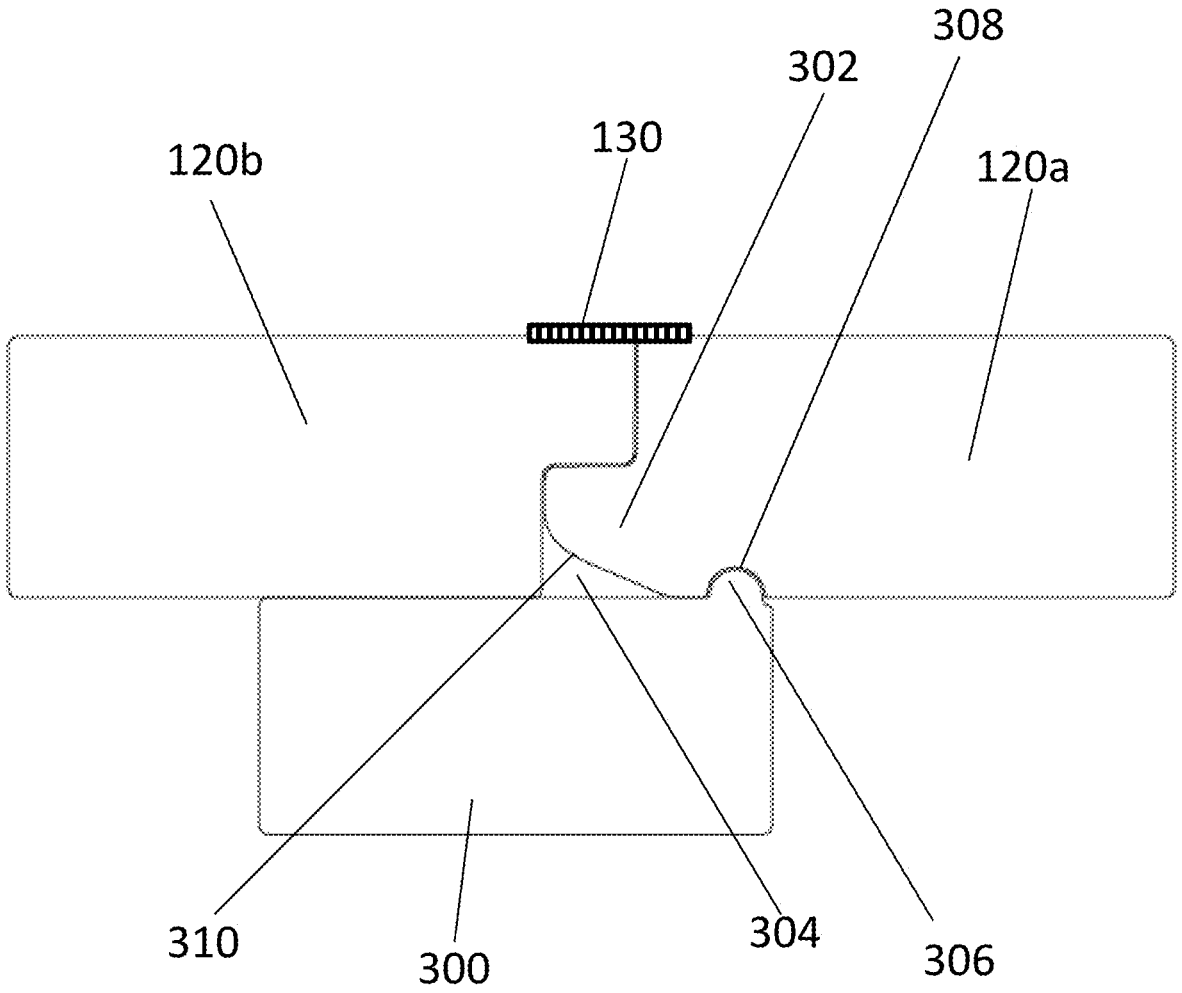
FIG. 3 is a cross-sectional view of an exemplary embodiment of a hinge side door jamb.

In certain embodiments, the front sections 120*a*, 122*a*, 124*a* may be secured to their corresponding back sections 120*b*, 122*b*, 124*b* via an interlock mechanism, where each front section 120*a*, 122*a*, or 124*a* contains a protrusion that snaps into and locks with a complementary channel in its respective back section 120*b*, 122*b*, or 124*b*. Of course, the reverse may also be effected, where the back section 120*b*, 122*b*, or 124*b* contains the protrusion, and the front section 120*a*, 122*a*, or 124*a* contains the channel. An exemplary embodiment is shown in FIG. 3, where the front section 120*a* contains a protrusion 302, and the back section 120*b* contains a channel 304 formed between the jamb 120*a* and its associated door stop 300. The door stop 300 is preferably mounted to the back sections 120*b*, 122*b*, 124*b*. When the door jamb 120 is place in its opened orientation, the protrusion 302 fits into the channel 304 to interlock together the front and back sections 120*a*, 120*b*, respectively. As illustrated in FIG. 3, the protrusion 302 may contain a beveled edge 310 to allow the back section 120*b* to slide easily into the channel 304.

Figure 4:
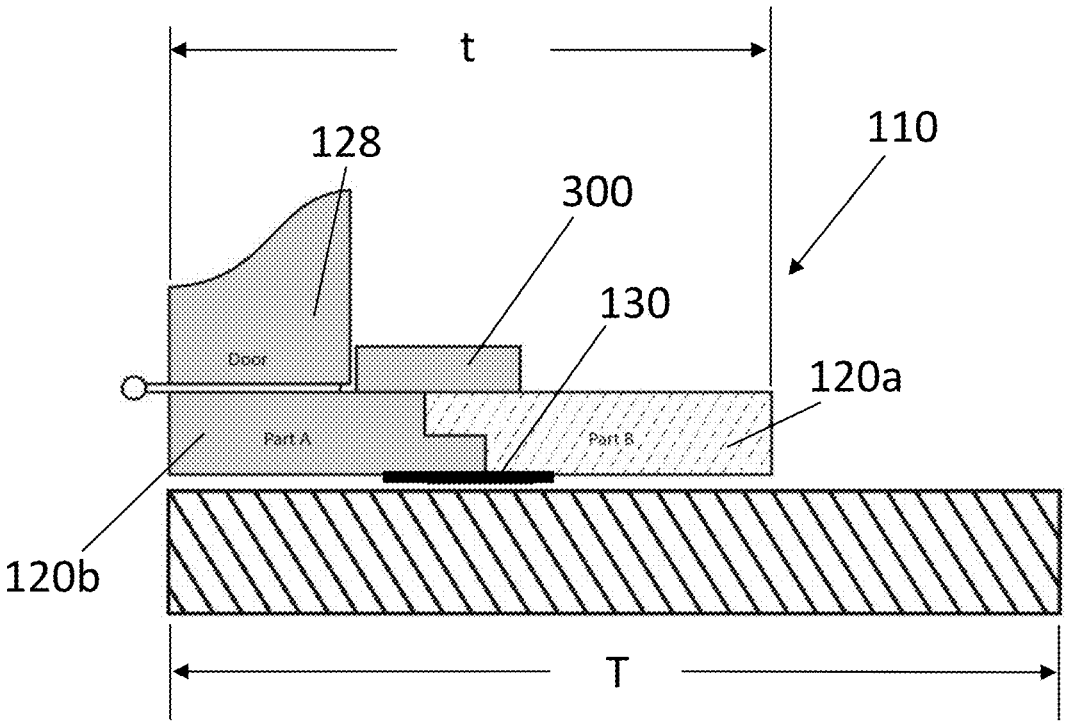
FIG. 4 is a fragmentary cross-sectional view of a hinge side door jamb placed in an opening that is thicker than the jamb.

In certain embodiments, the jamb 120 may also be held in its opened position by a tongue 306 on the door stop 300 that is lodged in a groove 308 in the back section 120*b*. Preferably, the tongue 306 and the groove 308 are configured so that the tongue 306 fits snugly into the groove 308 to hold the jamb 120 in its opened position without significant play. Likewise, it is preferred that the protrusion 302 and the channel 304 fit together snugly to hold the back section 120*b* and the front section 120*a* tightly together. In other embodiments, however, the tongue 306 and groove 308 may be eliminated (as best shown in FIG. 4). Although FIG. 3 shows the interlock mechanism for the hinge side jamb 120, the same may be effected for the lock side jamb 122 and the horizontal header 124. Other interlocking mechanisms also be apparent to those skilled in the art.

Figure 5:
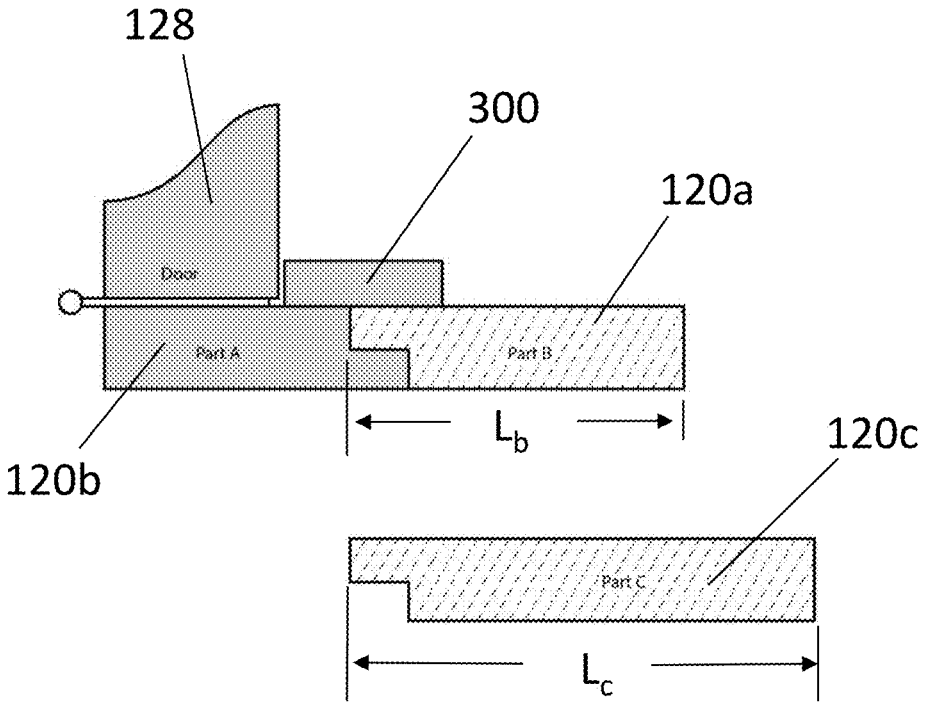
FIG. 5 is a fragmentary cross-sectional assembly drawing of a hinge side door jamb and its substitute back section.

In certain embodiments, the door frame may 110 may be installed in a wall opening that has a thickness which does not match that of the door frame 110. The thickness of the opening may be greater or less than the thickness of the door frame 110 (in its opened orientation). For example, as illustrated in FIG. 4, the thickness T of the opening may be greater than the thickness t of the door frame 110 in its opened orientation. In that case, a kit may be provided to replace the front sections 120*a*, 122*a*, 124*a* of the frame 110 with longer front sections 120*c*, 122*c*, 124*c* to match the thickness T of the opening. As best shown in FIG. 5, to match the thickness T of the opening, the front section 120*a*, having depth $L_b$, of the hinge side jamb 120, may be replaced with a substitute front section 120*c*, having depth $L_c$, wherein $L_c$ is greater than $L_b$. Of course, the front sections 122*a* and 124*a* may also be replaced with corresponding substitute front sections 122*c* and 124*c*. Thus, the kit contains three substitute front sections: a first substitute front section 120*c* for the hinge side jamb 120, a second substitute front section 122*c* for the lock side jamb 122, and a third substitute front section 124*c* for the horizontal header 124. The substitute front sections 120*c*, 122*c*, 124*c* replace the front section 120*a*, 122*a*, and 124*a*, respectively. Although, FIG. 5 shows the substitute front section 120*c* having a depth $L_c$ greater than $L_b$, the present invention also contemplates the reverse case ($L_c$ less than $L_b$), where the original frame 110 (in its opened orientation) has a thickness t greater than the thickness T of the wall opening. Preferably, the substitute front sections 120*c*, 122*c*, 124*c* contain the same interlock mechanism described above for the front sections 120*a*, 122*a*, and 124*a*, including protrusions 302 and grooves 308 to allow the substitute front sections 120*c*, 122*c*, 124*c* to interlock with their respective back sections 120*b*, 122*b*, 124*b* and door stop 300 (see FIG. 3).

During installation, if the thickness T of the building opening does not match the thickness t of the door frame 110, the installer may obtain a kit having substitute front sections 120*c*, 122*c*, 124*c* to match the thickness t of the frame with the thickness T of the opening. The installer may remove the front sections 120*a*, 122*a*, 124*a* from the frame 110, e.g. by cutting or removing hinges 130. The substitute front sections 120*c*, 122*c*, 124*c* are then used to replace front sections 120*a*, 122*a*, 124*a* to increase (or decrease) the thickness of the frame 110. The installer may slide the substitute front sections 120*c*, 122*c*, 124*c* in place adjacent to their respective back sections 120*b*, 122*b*, 124*b* and door stop 300, secure the substitute front jamb sections 120*c*, 122*c* to the substitute front header section 124*c* (e.g. by fasteners, such as screws, nails, brackets, or combinations thereof), and optionally reinstall hinges 130 to secure the substitute front sections 120*c*, 122*c*, 124*c* to their respective back sections 120*b*, 122*b*, 124*b*. Alternatively, a tape may be used to secure the substitute front sections 120*c*, 122*c*, 124*c* to their respective back sections 120*b*, 122*b*, 124*b*.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for installing a pre-hung door assembly, comprising the steps of:

a. providing a pre-hung door assembly comprising
   i. a frame containing a hinge side jamb, a lock side jamb, and a horizontal header jamb, the hinge side and lock side jambs disposed in spaced parallel relation and the header jamb connecting top ends of the hinge side and lock side jambs, wherein each of the jambs is made of a front section and an adjacent back section joined by a hinge configured to allow the front and back sections to be folded, and
   ii. a door slab mounted to the hinge side jamb;

b. unfolding the front and back sections of the jambs; and c. inserting and securing the unfolded pre-hung door assembly into a wall opening.

2. The method of claim 1, further comprising the steps of removing the front sections of the door jambs, and replacing the front sections of the door jambs with substitute front sections.

3. The method of claim 2, further comprising the steps of securing the replacement front sections to the back sections.

4. The method of claim 1, wherein the hinge is one of a bi-fold hinge, a living hinge integral with the associated jamb, and a resilient member.

5. The method of claim 1, wherein the jambs have a reduced thickness portion forming said hinge.

6. The method of claim 5, wherein each of the jambs comprises plastic or composite material.

7. The method of claim 1, wherein the hinge is a tape, a strap, or a bifold hinge.

8. The method of claim 1, wherein the hinge side jamb and the lock side jamb each comprise polymer composite or wood composite.

9. The method of claim 1, wherein the hinge is configured to allow each front section to be folded onto the associated back section.

10. The method of claim 1, wherein the hinge side jamb and the lock side jamb are flat jambs.

11. The method of claim 1, wherein each back section of each of the hinge side jamb, lock side jamb, and horizontal header has an attached or integral door stop.

12. The method of claim 1, further comprising the step of replacing each front section with a substitute front section.

13. The method of claim 12, wherein the substitute front section has a different depth than the front section.

14. The method of claim 12, wherein the substitute front section is provided as a kit along with the pre-hung door assembly.

15. A method for installing a pre-hung door assembly, comprising the steps of:

a. providing a pre-hung door assembly comprising
   i. a frame having a hinge side jamb, a lock side jamb, and a horizontal header jamb, the hinge side and lock side jambs disposed in spaced parallel relation and the header jamb connecting top ends of the hinge side and lock side jambs, wherein each of the jambs is made of a front section and an adjacent back section joined by a hinge configured to allow the front and back sections to be folded, wherein each back section of each of the hinge side jamb, lock side jamb, and horizontal header has an attached or integral door stop, and
   ii. a door slab mounted to the hinge side jamb, wherein each front section and associated back section are secured together via an interlock mechanism;

b. unfolding the front and back sections of the jambs; and c. inserting and securing the unfolded pre-hung door assembly into a wall opening.

16. The method of claim 15, wherein each front section has a protrusion and each back section has a channel, the protrusion locks with the associated channel and the door stop.

17. The method of claim 16, wherein each front section has a tongue and each back section has a groove.

18. The method of claim 15, further comprising the step of replacing each front section with a substitute front section.

19. The method of claim 18, wherein the substitute front section has a different depth than the front section.

20. The method of claim 18, wherein the substitute front section is provided as a kit along with the pre-hung door assembly.

* * * * *